US006866705B2

(12) United States Patent
Nielsen et al.

(10) Patent No.: US 6,866,705 B2
(45) Date of Patent: Mar. 15, 2005

(54) FLOOR FINISHING AND DUST COLLECTION APPARATUS

(76) Inventors: Larry Nielsen, 19002 SE. 15th St., Vancouver, WA (US) 98683; Randy Rowley, 6715 SE. Fern, Portland, OR (US) 97206

( * ) Notice: Subject to any disclaimer, the term of this patent is extended or adjusted under 35 U.S.C. 154(b) by 0 days.

(21) Appl. No.: 09/882,484

(22) Filed: Jun. 15, 2001

(65) Prior Publication Data

US 2002/0193056 A1 Dec. 19, 2002

(51) Int. Cl.[7] ..... B01D 47/02

(52) U.S. Cl. ..... 96/276; 15/353; 96/279; 96/333; 96/335; 96/348; 96/349; 96/350; 96/351; 55/DIG. 3

(58) Field of Search ..... 95/226; 55/DIG. 3; 96/269, 276, 278, 279, 329, 333, 334, 335, 337, 338, 340, 342, 343, 344, 345, 348, 349, 350, 351, 352, 353, 354; 15/353

(56) References Cited

U.S. PATENT DOCUMENTS

| | | | | |
|---|---|---|---|---|
| 793,062 | A | * | 6/1905 | Duke |
| 807,283 | A | * | 12/1905 | Kenney |
| 941,676 | A | * | 11/1909 | Green |
| 996,991 | A | * | 7/1911 | Little |
| 1,458,720 | A | * | 6/1923 | Malone |
| 2,954,095 | A | * | 9/1960 | Brock |
| 3,130,024 | A | * | 4/1964 | Vaughan, Jr. |
| 4,121,915 | A | * | 10/1978 | Anderson |
| 4,457,036 | A | | 7/1984 | Carlson et al. |
| 4,547,206 | A | * | 10/1985 | Sovis et al. |
| 4,590,635 | A | | 5/1986 | Tucker et al. |
| 4,598,440 | A | | 7/1986 | Wilson |
| 4,631,775 | A | | 12/1986 | Palmer et al. |
| 4,678,485 | A | | 7/1987 | Finley et al. |
| 4,701,976 | A | | 10/1987 | Palmer et al. |
| 4,720,886 | A | | 1/1988 | McLeod et al. |
| 4,731,956 | A | | 3/1988 | Wood |
| 4,809,385 | A | | 3/1989 | Bogue |
| 4,818,259 | A | * | 4/1989 | Marano |
| 4,874,404 | A | * | 10/1989 | Boswell |
| 4,939,811 | A | | 7/1990 | Matunaga et al. |
| 5,088,151 | A | | 2/1992 | Legatt |
| 5,192,344 | A | * | 3/1993 | House |
| 5,199,963 | A | * | 4/1993 | Scarp |
| 5,253,384 | A | | 10/1993 | Joines et al. |
| 5,326,383 | A | * | 7/1994 | Harris |
| 5,354,347 | A | * | 10/1994 | McCoy et al. |
| 5,363,600 | A | | 11/1994 | Shishido et al. |
| 5,388,305 | A | | 2/1995 | Fields |
| 5,428,865 | A | * | 7/1995 | Yarbrough et al. |
| 5,435,817 | A | | 7/1995 | Davis et al. |
| 5,458,532 | A | | 10/1995 | Cannone |
| 5,666,689 | A | | 9/1997 | Andersen |
| 5,922,093 | A | | 7/1999 | James et al. |
| 5,958,113 | A | * | 9/1999 | Collins et al. |
| 5,974,626 | A | | 11/1999 | Wood et al. |
| 6,083,307 | A | * | 7/2000 | Dular |

OTHER PUBLICATIONS

Pullman Holt Corporation, Pullman Holt 1994 Product Catalog, 1994.

* cited by examiner

*Primary Examiner*—Duane S. Smith
(74) *Attorney, Agent, or Firm*—Chernoff, Vilhauer, McClung & Stenzel, LLP

(57) ABSTRACT

Sanding and screening are steps in floor finishing that produce large quantities of fine dust which is difficult to remove and which plugs porous filter elements of dust collection systems. Dust collection is enhanced with a floor screening attachment for a floor machine. A vacuum system with a liquid filtering medium is provided to collect dust produced during screening. A dust collection unit is also disclosed to collect and separate sawdust produced by sanding which can cause foaming of a liquid filter medium.

10 Claims, 9 Drawing Sheets

FLOOR FINISHING AND DUST COLLECTION APPARATUS

CROSS-REFERENCE TO RELATED APPLICATIONS

Not applicable.

BACKGROUND OF THE INVENTION

The present invention relates to floor maintenance equipment and, more particularly, to a floor screening attachment and a dust collection system for a floor finishing machine.

As a result of traffic induced wear, wood floors must be periodically refinished. Before the new finish is applied, the existing finish is sanded lightly or screened to promote adhesion of the new and old finishes. Screening is typically performed with a rotary floor machine of the type used for buffing, scrubbing, polishing, and a number of other floor maintenance operations. Referring to FIG. 1, typically, a floor machine 10 comprises a chassis 12 with an attached operator control handle 14. To facilitate moving the machine 10, a pair of wheels 16 is attached to the chassis 12 supporting the floor machine 10 when it is tipped in the direction of the handle 14. A large diameter circular pad driver 18, located under the chassis 12, is connected to and rotated by a drive shaft 24 that is powered by a motor 20 and gear train 22 mounted in the chassis 12. The pad 26 that performs the polishing, buffing, or other floor care operation is trapped between the pad driver and the floor. Friction between the pad driver 26 and the pad causes the pad to rotate with the pad driver 18. For floor screening, the "pad" or screen 26 comprises an abrasive coated open mesh cloth having the appearance of window screen. Typically, the pad driver 18 used with a screen 26 is faced with felt to provide a resilient backing for the screen 26. Slippage between the felt face of the pad driver 18 and the screen 26 erodes the abrasive coating of the screen 26. The life of the abrasive on the side of the screen in contact with the pad driver 18 may be reduced by up to 50%. Since both sides of the screen 26 may be used to abrade the floor, slippage between the screen and pad driver results in a substantial increase in the cost of abrasives required to perform a screening operation.

A second problem inherent in floor screening is the production of a large quantity of fine sanding dust. The dust can be controlled and collected with a wet screening process where water is spread on the floor prior to screening. The dust produced by screening mixes with the water to form a slurry that is removed from the floor by mopping. However, the slurry is difficult clean and its presence on the floor surface obscures the surface making it difficult to judge the progress and quality of the screening operation. For these reasons, floors may be screened while dry. However, the dry screening dust easily becomes airborne and must be cleaned from any horizontal or inclined surface in the vicinity of the screening project. Further, the fine airborne finish particles produced by screening may present a health hazard.

To reduce the airborne dust produced by screening, specialized floor machines with dust collection systems have been devised. Typically, the dust collection system comprises an industrial vacuum cleaner connected to a shroud enclosing the top and the perimeter of the pad driver of the special machine. A special floor machine with a dust collection system may be justifiable for floor refinishing contractors, but many facilities have floor machines that are not equipped for dust collection and a special machine is not justifiable for periodic floor refinishing projects. Further, the quantity and fine nature of the dust produced by screening limits the effectiveness of the typical dust collection system. First, the felt pad driver used for screening comprises random fibers and has limited porosity. Air passages in the felt will quickly plug when air laden with screening dust is drawn through the felt. Since air cannot be drawn through the pad driver without frequent cleaning, the dust becomes trapped in the mesh of the screen and dust collection is only effective when the dust leaks from the edges of the screen disk. In addition, industrial vacuum cleaners rely on a dry filter element that traps particles on the surface of the element when air is drawn through pores of the filter medium. The fine dust produced by screening rapidly plugs the pores of the filter medium and the filter element must be frequently changed or cleaned if the vacuum cleaner is to continue to function.

James et al., U.S. Pat. No. 5,922,093, disclose an ultra-filtration vacuum system that includes multiple liquid and dry filtering stages. Contaminated air drawn into the cannister of the vacuum is directed into a cyclonic air stream that separates large particles and debris from the air. The separated material collects in a first liquid filter medium in the bottom of the cannister. After cyclonic cleaning, the air passes through a labyrinth filter and is injected below the surface a second liquid filter medium. The air forms bubbles that rise to the surface of the liquid where many of the bubbles collapse. The air and liquid are then dispersed in a dispersion chamber. Particles entrained in the air are wetted by the liquid and a combination of cyclonic action and baffles in the dispersion chamber separate the mixture of liquid and wetted particles which flows back into the second liquid filter medium. Particulates remaining entrained in the air are filtered by a final dry filter element. While the vacuum system throughly filters the air, it is complex and not well suited to handling large quantities of fine dust produced by floor screening. Cyclonic cleaning relies on centrifugal force to separate heavy particles and debris from the air stream but is of limited usefulness for removing the fine, light weight particles produced by floor screening. When used for floor screening, the intermediate labyrinth filter would be exposed to essentially unfiltered air and subject to rapid plugging by the screening dust. Injecting contaminated air into a liquid filter media is an effective method of filtering out fine particles, but the volume of liquid in the second liquid filter stage is limited by the necessary equipment and the presence of the first stage filter in the cannister and would rapidly reach its capacity of particulate matter when exposed to the volume of dust produced by screening.

If the finish is severely worn, floor screening may not be sufficient to prepare the floor for refinishing. In this case, as with newly installed floors, sanding the wood of the floor may be necessary to prepare the surface for the application of the finish. Floor sanding is performed with large belt or drum sanders. Like floor screening, floor sanding creates substantial quantities of dust. As is the case with floor screening, the large quantity of dust will rapidly plug a dry filter of a dust collection system. In addition, the presence of wood in the sanding dust causes foaming in a liquid filter medium severely limiting its effectiveness. Anti-foaming chemicals can reduce the foaming, but the chemicals are only partially effective. Further, adding chemicals to the liquid filter medium significantly increases the cost of floor finishing because the large quantity of dust requires the liquid medium and the anti-foaming chemicals be frequently replaced.

What is desired, therefore, is an apparatus for converting a standard floor machine to a floor screening machine and an effective, large capacity dust collection system suitable for floor screening and sanding operations.

DETAILED DESCRIPTION OF THE INVENTION

Figure 1:
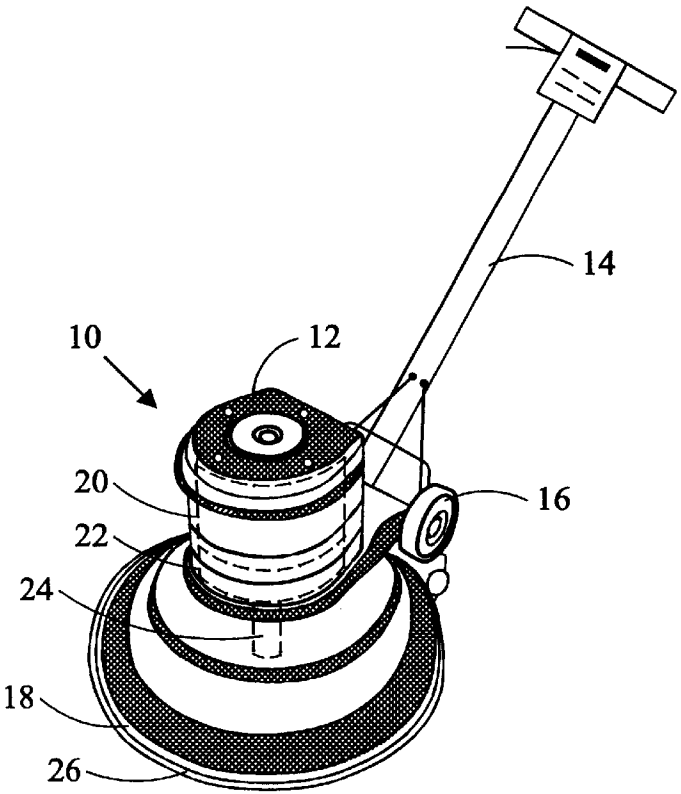
FIG. 1 (PRIOR ART)
FIG. 1 is a perspective view of a floor machine.
Figure 2:
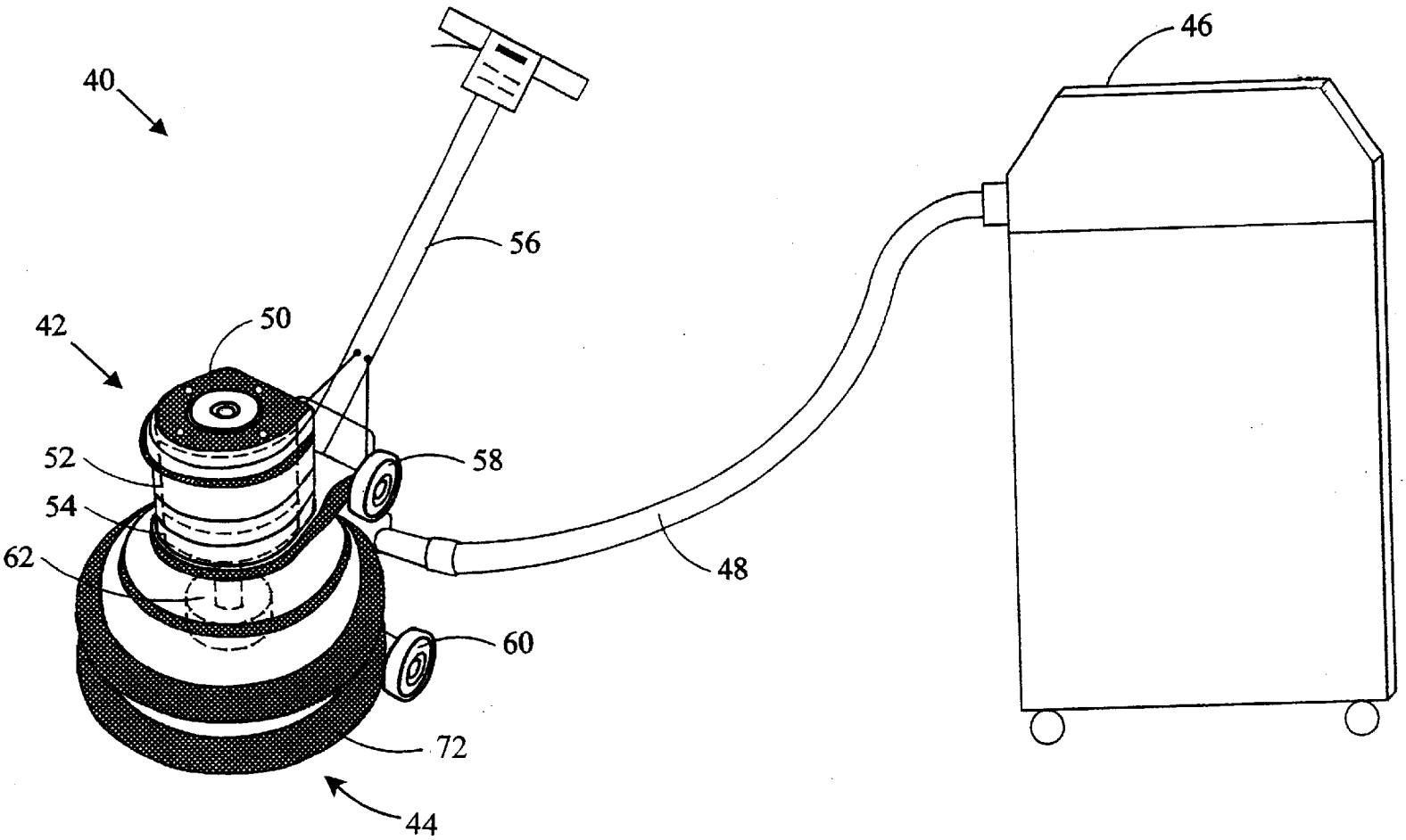
FIG. 2 is a perspective view of a floor machine with the floor screening attachment and an elevation view of a dust collection vacuum system.

Referring to FIG. 2, the floor screening system 40 of the present invention generally comprises a floor machine 42, a floor screening attachment 44, and a dust collection vacuum system 46 connected to the floor screening attachment 44 by a hose 48. The floor machine 42 comprises a chassis 50 enclosing a motor 52 and a gear train 54. The chassis 50 also provides a connection point for a handle 56 for operator control of the floor machine 42. Typically, floor machines are equipped with a pair of wheels 58 attached to the chassis 50 and arranged to engage the floor when the floor machine 42 is tipped toward the handle 56. The wheels 58 provide a convenient support for the floor machine when moving between work areas. The floor screening attachment 44 is fitted with wheels 60 mounted for rotation and attached to the shroud 72. Since the screening attachment 44 elevates the chassis 50, the wheels of the floor machine 58 may not be useful for moving the floor machine when the screening attachment is in place. The wheels 60 can be used for moving the floor machine 42 when it is equipped with the screening attachment 44.

Figure 3:
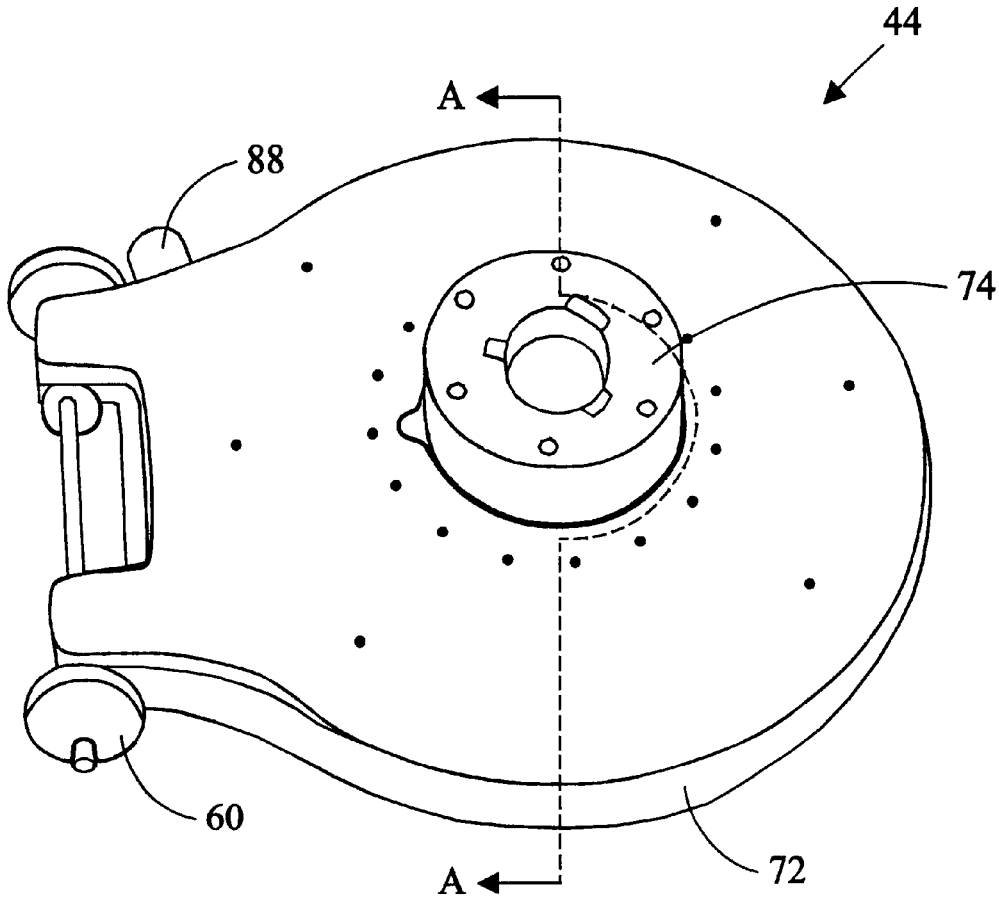
FIG. 3 is a perspective view of the floor screening attachment.
Figure 4:
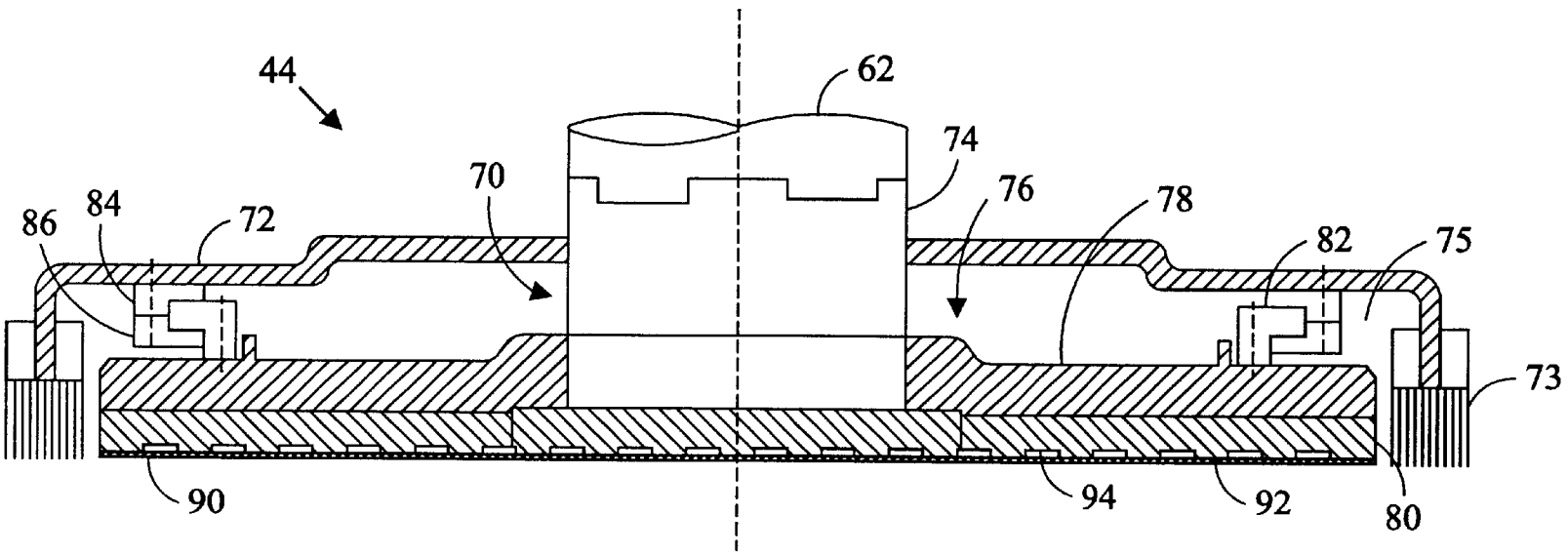
FIG. 4 is a cross section of the floor screening attachment of FIG. 3 along line A—A.

Referring to FIGS. 2, 3, and 4, the floor screening attachment 44 comprises generally a pad driver 70 and a shroud 72 mounted for rotation independent of the pad driver. The pad driver 70 includes a pad driver shaft 74 having a first end providing an interface to the powered drive shaft 62 projecting from the gear box of the floor machine 42. The interface between the pad driver shaft 74 and the drive shaft 62 of the floor machine is dictated by the design of the floor machine but, by way of example only, may be provided by intermeshing projections as illustrated in FIG. 4. A circular sanding block 76 is affixed to the second end of the pad driver shaft 74. The sanding block comprises a backing plate 78 and a facing 80. The backing plate 78 is a disk that supports the facing 80 and controls distortion of the facing which could cause unevenness of the screened surface. A bearing and seal 82 is affixed to the upper surface of the backing plate 78 and engages complementary bearing and sealing rings 84 and 86 attached to the shroud 72.

The shroud 72 of the screening attachment 44 includes a connector 88 for a hose 48 to the dust collection vacuum system 46. The bearing and sealing ring 82, 84, and 86, in conjunction with the shroud 72, form a plenum 75 around the periphery of the backing plate 78 in communication with the connector 88. The pressure differential created in the plenum 75 by the vacuum source draws air through an approximately annular aperture between the shroud 72 and the backing plate 76 to move air entrained dust particles to the hose connection outlet 88. The shroud 72 may be extended by a skirt 73, such as a brush type screen or flexible element, to aid in confining dust expelled from the perimeter of the screen 90. Preferably the skirt 73 comprises a flexible, non-porous material such as rubber or plastic that stops short of the floor to permit air to flow into the plenum 75. However, the skirt 73 may comprise a brush or other porous material to permit air to flow into the plenum 75.

Figure 5:
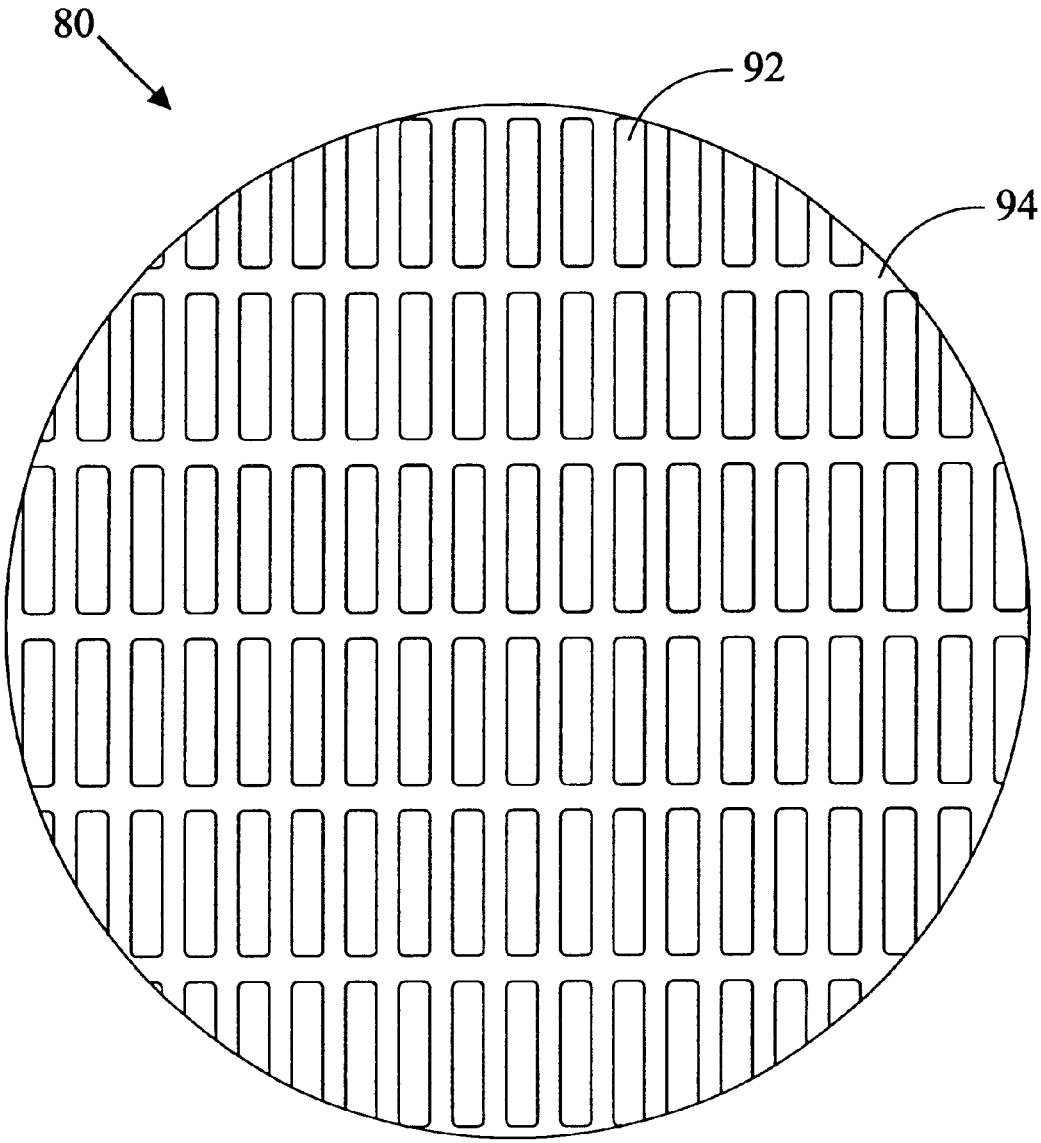
FIG. 5 is a plan view of the bottom of the facing of the sanding block of the floor screening attachment.

The screen 90 typically comprises an open mesh cloth coated with silicon carbide or another abrasive. When the sanding block 76 is rotated, friction between the facing 80 and the screen 90 causes the screen to rotate. To reduce slippage between the screen 90 and the facing 80 and resulting erosion of the abrasive from the screen 90 the present inventors concluded that facing should utilize a material having a high coefficient of friction with the mesh material. Further, the inventors concluded that when air is drawn through the prior art felt sanding block facing the passages in the felt quickly plug with dust limiting the effectiveness of the dust collection system. As a result, dust becomes trapped between the mesh of the screen and the felt facing. Since the vacuum system cannot draw air and dust through the plugged felt, the dust collection system is limited to collecting dust that migrates to the edge of the screen disk. The facing 80 of the sanding block 76 of the present invention comprises a plurality of spaced apart raised surfaces 92. As illustrated in FIG. 5, the spaced apart, raised surfaces 92 are separated by surfaces 94 having a portion in relief of the raised surfaces 92 to create a pattern of channels through which air and entrained dust particles can migrate to reach the perimeter of disk for collection by the vacuum system. Rubber compounds, synthetic rubbers, plastics, and similar materials provide high friction between the screen 90 and the facing to reduce slippage and erosion of the abrasive, resilience to protect the sanded surface, and are moldable to form the plurality of spaced apart raised surfaces 92 useful in promoting air flow and dust collection.

Figure 6:
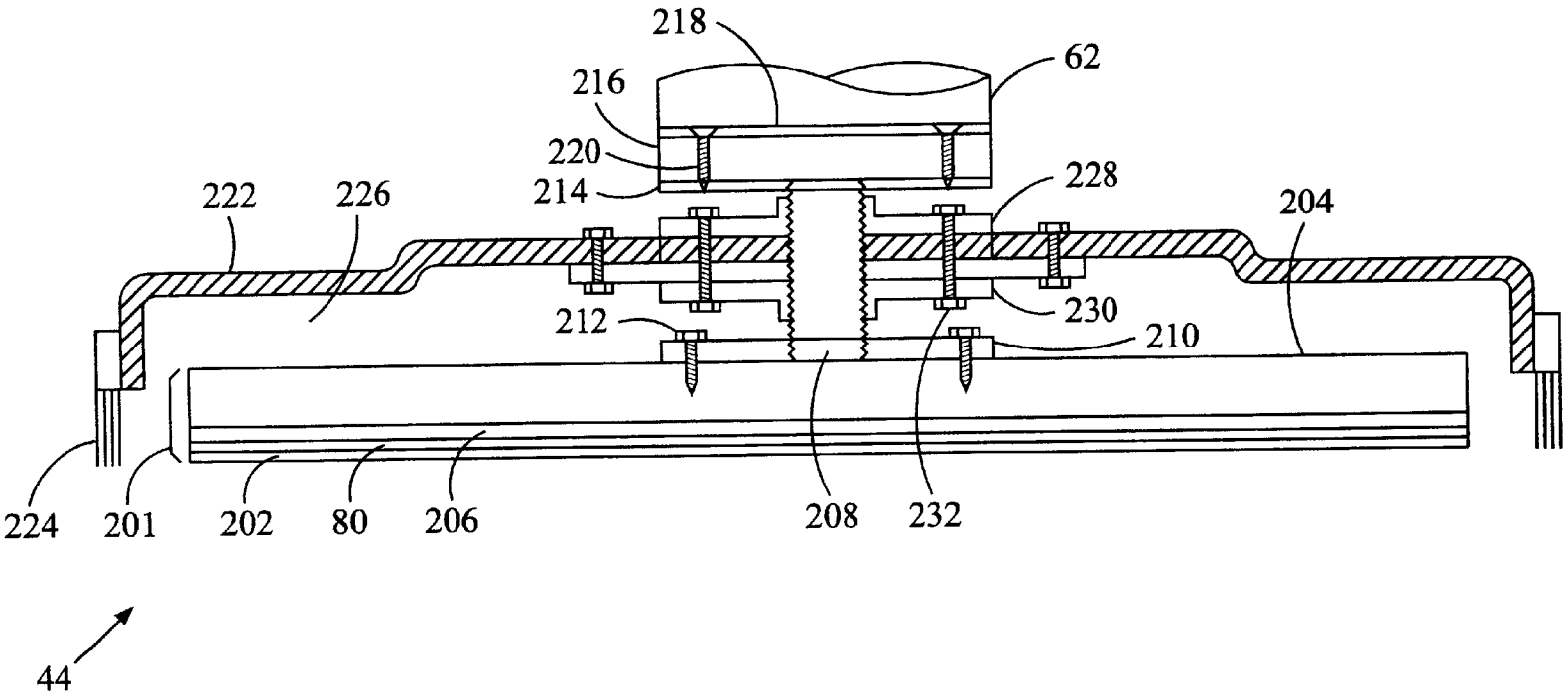
FIG. 6 is a cross section of a floor screening attachment of an alternative construction.

FIG. 6 illustrates an alternative construction for the floor screening attachment 44 of the present invention. The floor screen 202 is supported by a sanding block 201 (illustrated by a bracket) comprising a wooden backing plate 204 and a facing 80 as described above. To improve conformance of the screen 202 with the floor surface, a compliant pad 206 may be placed between the facing 80 and the wooden backing plate 204. The sanding block is driven by a shaft 208 affixed to a flange 210 that is attached to the wooden backing plate with screws 212. The opposite end of the shaft 208 is affixed to a second flange 214 that is attached to riser 216 and a clutch plate 218 by screws 220. The drive shaft 62 of a floor machine 42 engages the clutch plate 218 to drive the sanding block 201. A shroud 222 with a skirt 224 forms a plenum 226 about the exposed periphery of the sanding block 201. A vacuum source (not illustrated) attached to the shroud draws air contaminated with dust from the plenum 226. A pair of bearings having flanged outer cases 228 and 230 attached to the shroud 222 with screws 232, permit the shaft 208 to rotate independent of the shroud 222.

Figure 7:
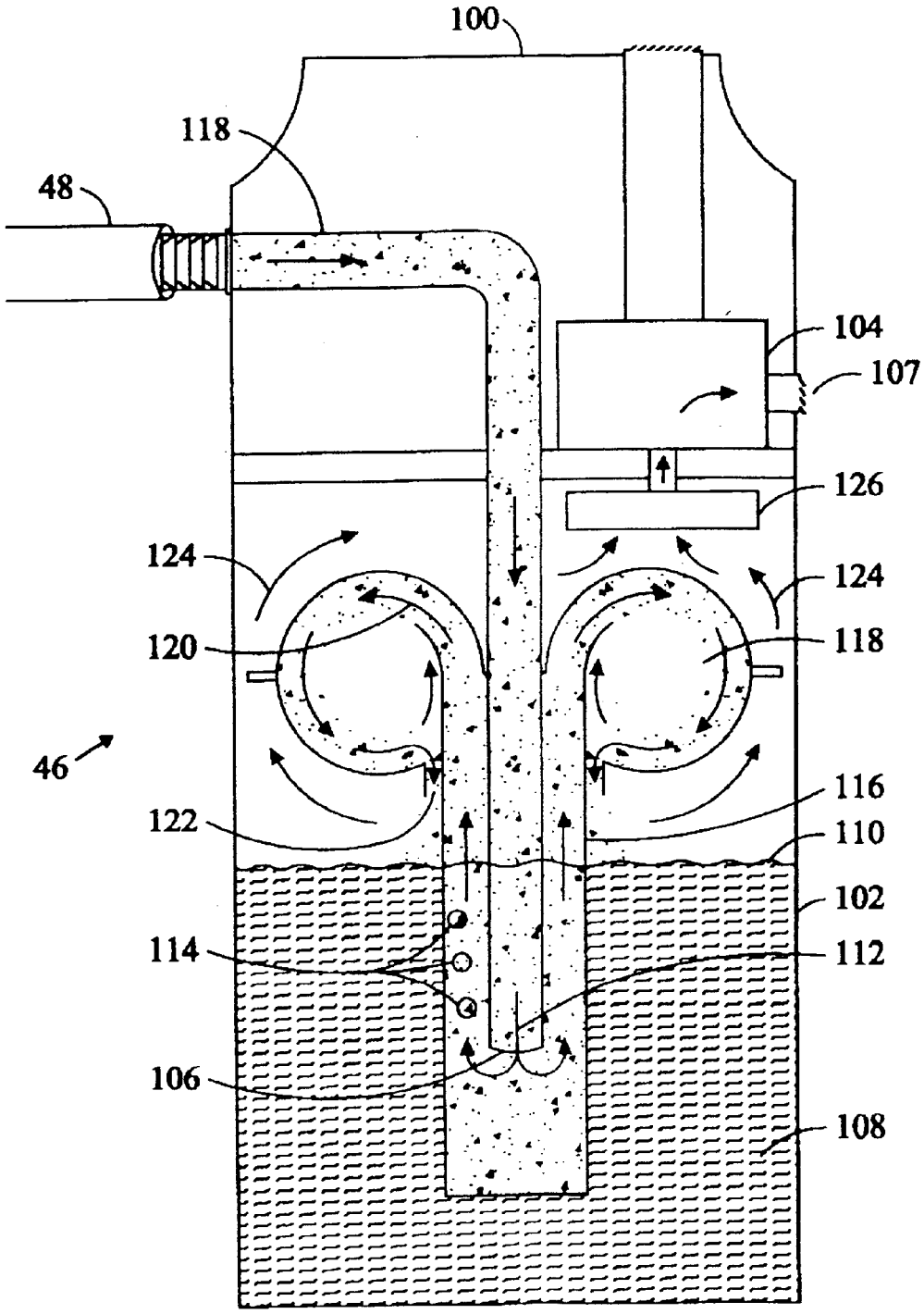
FIG. 7 is a schematic representation of a cross section of the dust collection vacuum system.

Referring to FIG. 7, the vacuum system 46 of the present invention is connected to the screening attachment 44 by a hose 48. The vacuum system 46 comprises generally a motor enclosure 100 and a container or cannister 102. A vacuum source 104 (typically a motor and a fan) creates a pressure differential between the inlet 106 to the cannister and an air outlet 107. A volume of liquid 108 (typically water) fills the cannister to a liquid level 110. The inlet 106 for contaminated air drawn from the screening attachment is submerged in the liquid 108. As the contaminated air 112 (indicated by an arrow) emerges from the submerged inlet 106 particles entrained in the air are wetted by and trapped in the liquid 108. However, the surface tension of the liquid 108 also results in bubbles 114 and particles in the air trapped within the bubbles may not be wetted by the liquid. The bubbles 114 rise to the surface 110 of the liquid 108. Particles within bubbles collapsing on the surface 110 of the liquid are wetted and trapped in the liquid 108. Air and liquid are drawn up through a mixer 116 which further mixes the liquid and air further wetting entrained particles. The mixer 116 comprises a larger diameter tube concentric with the tube 118 leading from the hose to the inlet 106. The mixture of air, liquid, and particles exits the mixing chamber 116 and enters a separator 118. The separator 118 comprises a hollow toroid of generally circular cross-section surrounding the tube 118 leading to the inlet 106. As the mixture of air and liquid is deflected by the curved walls of the separator and forced to change direction 120 (indicated by an arrow) additional bubbles are collapsed by the walls and additional particles are wetted by the liquid. As the moving mixture is further forced around the curved interior of the separator 118, the heavier liquid and wetted particles are forced to the walls of the separator by centrifugal force. A slurry of liquid and wetted particles exits the mixing and separation chamber 118 at an exit aperture 122 and drops under the influence of gravity into the volume of liquid 108 in the bottom of the cannister 102. Filtered air 124 exiting the separator chamber 118 is drawn to the outlet 107 by the pressure differential produced by the vacuum source 104. Before exiting the cannister 102, the air may also be filtered by a secondary dry filter 126 positioned in the air flow path. The large volume of liquid 108 in the cannister 102 provides substantial capacity to absorb dust produced by the screening operation permitting the work to continue without the need to change or clean filters. Liquid filtration avoids filter clogging encountered with industrial vacuums during screening.

Figure 8:
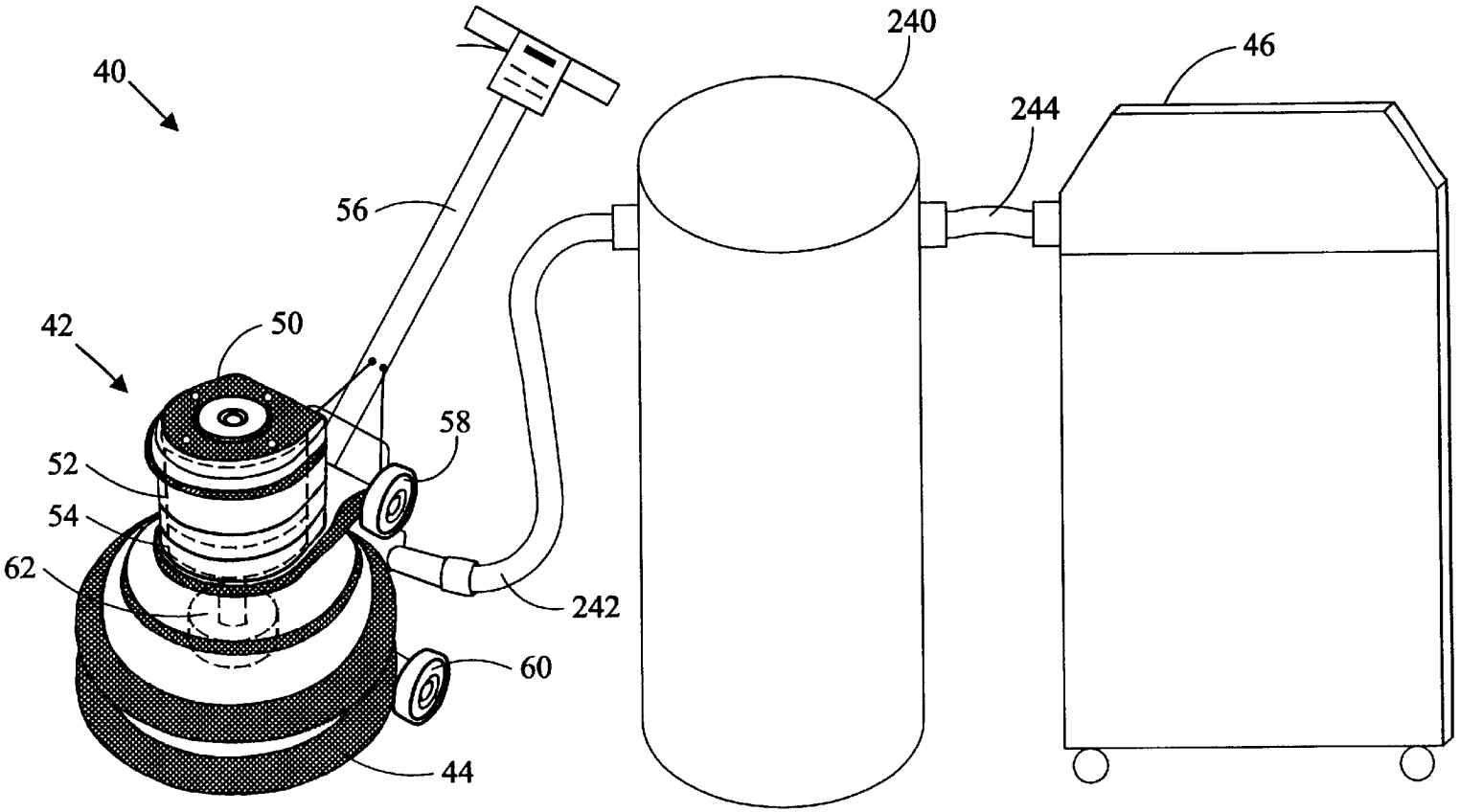
FIG. 8 is a view of dust collection system including a dust collection unit for floor machine.

The vacuum system 46 provides substantial capacity for capturing dust produced by floor screening operations and can be used for other floor finishing operations, such as sanding. The wood of a new floor must be sanded to prepare the surface for finishing. Likewise, if an existing finish is severely worn sanding may be necessary to restore the surface for refinishing. Sanding can be performed with floor screening machines, drum sanders and belt sanders and produces as great or greater quantities of dust than floor screening. Further, the wood in the sawdust produced by floor sanding aggravates foaming of a liquid dust filter medium substantially reducing the effectiveness of liquid in trapping dust. Anti-foaming chemicals can be added to the liquid to reduce the foaming but the chemicals are only partially effective. In addition, the absorption of large quantities of dust requires frequent disposal of the liquid medium and the anti-foaming chemicals substantially increasing the cost of sanding. Referring to FIG. 8, to increase the dust containment capacity of the system and reduce problems created by foaming of a liquid dust filter medium during sanding operations, the floor finishing system of the present invention may include a dust removal unit 240 to remove a substantial portion of the dust from the air stream before reaching the vacuum 46. The components of the system having counterparts illustrated in FIG. 2 and performing the same functions are assigned like numerals. The vacuum 46 draws dust laden air from the screening attachment 44 through the hose 242 into the dust removal unit 240. A hose 244 connects the dust removal unit 240 to the vacuum 46. A belt or drum sander may be used instead of a floor machine for sanding operations. Sanders and other floor finishing machines may include a fan to draw air from the vicinity of the working portion of the sanding or tool and expel it through the hose 242 to the dust removal unit 240 eliminating the need for the separate vacuum source 46.

Figure 9:
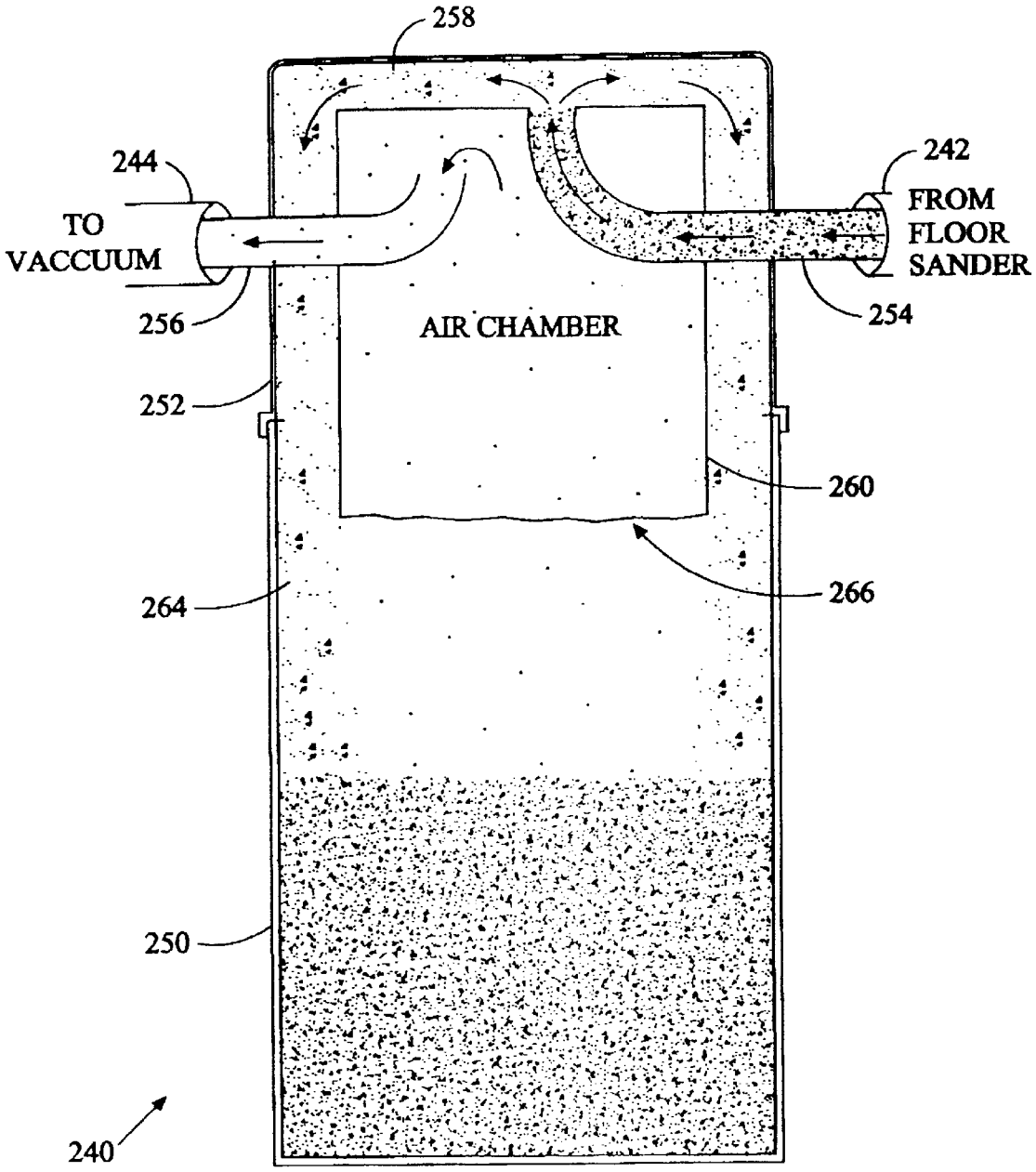
FIG. 9 is a cross section of a dust collection unit of the present invention.

Referring to FIG. 9, the dust removal unit 240 comprises generally a dust collection tank 250 sealed with a lid 252. Sawdust laden air is drawn from the vicinity of the sanding element or tool of a floor screening machine, sander, or other floor finishing tool through the hose 242 to an inlet tube 254 of the dust removal unit 240. Air contaminated with dust flows through the hose 242 into the dust removal unit 240 as a result of an air pressure differential between the inlet tube 254 and an outlet tube 256. The air pressure differential can be created by an air moving device, such as a vacuum source 46 connected to the outlet tube 256 by a hose 244 as illustrated in FIG. 8 or by a fan at the floor finishing machine.

Air including suspended dust entering the dust removal unit 240 is directed toward the underside of the top surface of the lid 252 into a first passage 258. The first passage 258 is bounded by the underside of the lid 252 and an upper surface of a secondary chamber structure 260 suspended generally centrally in the lid 252 by attachment to the inlet 254 and outlet 256 tubes. The secondary chamber structure 260 is generally a hollow cylinder with a closed upper end. The velocity of the air is substantially reduced when the air flow is redirected by the surface of the lid 252 and diffused in the first passage 258 which has a cross-section substantially larger than the inlet tube 254. As a result of the pressure differential between the inlet tube 254 and outlet tube 256 air flows to a second passage 264 in fluid communication with the first passage 258. The second passage 264 has a cross-section greater the first passage 258 causing the dust laden air to further decelerate. As the velocity of the air decreases in the second passage 264 the dust particles can no longer be supported by the air and fall to the bottom of the tank under the influence of gravity. The air exiting the second passage 264 is further decelerated as its direction is changed to enter a third passage 266 defined by the interior surfaces of the secondary chamber structure 260. The further reduction in velocity releases substantially all of the dust remaining suspended in the air. The air exits the third passage 266 through the outlet tube 256.

For floor refinishing operations, the system of the present invention provides a floor machine that can be quickly and conveniently converted to a floor screening machine. An effective dust collection system for the floor screening machine eliminates air borne contaminants and messy wet screening operations. The system can also include a dust collection unit to remove dust produces by floor sanding which can produce foaming of a liquid dust filter medium.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

The invention claimed is:

1. A vacuum system comprising:

(a) a cannister;

(b) a volume of liquid having a level in said cannister;

(c) an inlet for air including an entrained contaminant, said inlet located below said level of said liquid;

(d) a mixer for mixing said liquid with said air and said contaminant from said inlet to facilitate wetting of said contaminant with said liquid;

(e) a separator comprising a curved surface spaced above said level of said liquid and arranged in a path of a flow of said mixture of said air, contaminant, and liquid from said mixer, said curved surface deflecting said flow of said mixture so as to cause said liquid and wetted contaminant to separate from said air, cling to said curved surface, and drain into said volume of liquid; and (f) a vacuum source to create an air pressure differential between said inlet and an air outlet from said tank.

2. The apparatus of claim 1 wherein said separator comprises a deflector for changing a direction of a flow of said mixture from said mixer.

3. A dust collection apparatus comprising:

(a) a container;

(b) an inlet to said container for a flow of air and entrained dust;

(c) a first passage in fluid communication with said inlet, said first passage having a cross-section larger than a cross-section of said inlet;

(d) a second passage in fluid communication with said first passage, said second passage having a cross-section larger than said cross-section of said first passage to cause air flowing from said first passage to said second passage to decelerate causing said entrained dust to separate from said air and collect in said container;

(e) a third passage in fluid communication with first passage through said second passage and arranged to cause said air to flow in a new direction;

(f) an outlet from said container in fluid communication with said third passage; and (g) an air moving device to maintain an air pressure differential between said inlet and said outlet.

4. The apparatus of claim 3 further comprising a filter element removing dust from said air entering said third passage.

5. The apparatus of claim 3 wherein said air moving device comprises a fan to create a higher pressure at said inlet than said outlet.

6. The apparatus of claim 3 wherein said air moving device comprises a vacuum system at said outlet.

7. The apparatus of claim 3 wherein said air moving device comprises:

(a) a cannister;

(b) a volume of liquid having a level in said cannister;

(c) an inlet for air including an entrained contaminant, said inlet located below said level of said liquid;

(d) a mixer for mixing said liquid with said air and said contaminant from said inlet to facilitate wetting of said contaminant with said liquid;

(e) a separator comprising a curved surface spaced above said level of said liquid and arranged in a path of a flow of said mixture of said air, contaminant, and liquid from said mixer, said curved surface deflecting said flow of said mixture so as to cause said liquid and wetted contaminant to separate from said air, cling to said curved surface, and drain into said volume of liquid; and (f) a vacuum source to create an air pressure differential between said inlet and an air outlet from said tank.

8. A vacuum system comprising:

(a) a cannister containing a volume of liquid having a liquid level;

(b) an inlet tube having a first end connected to a source of air containing an entrained contaminant and a second end located below said level of said liquid;

(c) a mixer arranged substantially concentric to said inlet tube and having a first end located below said level of said liquid and a second end, said mixer mixing said liquid and a flow of said contaminated air from said second end of said inlet tube to wet said entrained contaminant with said liquid;

(d) a substantially toroidal, hollow separator comprising a curved wall having an inside surface, an outside surface, a first portion forming an outlet aperture connecting said inside and said outside surfaces, and a second portion forming an inlet aperture to receive a flow of said mixture of air, liquid, and contaminant from said mixer, said inside surface being arranged such that said flow of said mixture impinges upon said inside surface altering a direction of said flow and causing said liquid and said contaminant to separate from said air, collect on said inside surface, and drain into said liquid in said cannister; and (e) a source of differential pressure between said first end of said inlet tube and said outlet aperture of said separator.

9. The vacuum system of claim 8 further comprising:

(a) a container;

(b) a container inlet connected to a source of air, said air including entrained dust;

(c) a first passage in fluid communication with said container inlet, said first passage having a cross-section larger than a cross-section of said inlet;

(d) a second passage in fluid communication with said first passage, said second passage having a cross-section larger than said cross-section of said first passage to cause air flowing from said first passage to said second passage to decelerate causing said entrained dust to separate from said air and collect in said container; and (e) a third passage in fluid communication with first passage through said second passage and arranged to cause said air to flow in a new direction, said third passage including an outlet in fluid communication with said first end of said inlet tube.

10. The vacuum system of claim 9 further comprising a filter element removing dust from said air entering said third passage.

* * * * *